US006502667B1

(12) United States Patent
Mead et al.

(10) Patent No.: US 6,502,667 B1
(45) Date of Patent: Jan. 7, 2003

(54) ERGONOMIC PLATFORM LIFT

(75) Inventors: Roy W. Mead, Beavercreek, OH (US); Michael R. Smoot, Englewood, OH (US)

(73) Assignee: JoyceDayton Corporation, Dayton, OH (US)

( * ) Notice: Subject to any disclaimer, the term of this patent is extended or adjusted under 35 U.S.C. 154(b) by 0 days.

(21) Appl. No.: 09/803,742

(22) Filed: Mar. 8, 2001

(51) Int. Cl.[7] ..... B66F 7/14
(52) U.S. Cl. ..... 187/214; 187/267
(58) Field of Search ..... 182/141, 147; 187/205, 214, 267, 268, 215

(56) References Cited

U.S. PATENT DOCUMENTS

| | | | | |
|---|---|---|---|---|
| 103,546 A | | 5/1870 | Berger | |
| 1,660,275 A | * | 2/1928 | Russel | 187/267 X |
| 3,851,854 A | | 12/1974 | Roybal | |
| 4,065,194 A | * | 12/1977 | Mattia | 312/247 |
| 4,365,801 A | | 12/1982 | Medina et al. | |
| 4,619,346 A | | 10/1986 | Deguerry | |
| 4,752,102 A | | 6/1988 | Rasmussen | |
| 4,967,733 A | | 11/1990 | Rousseau | |
| 5,154,569 A | | 10/1992 | Eryou et al. | |
| 5,217,090 A | | 6/1993 | Billington, III et al. | |
| 5,310,018 A | | 5/1994 | Lahaie | |
| 5,408,940 A | * | 4/1995 | Winchell | 108/147 |
| 5,636,394 A | * | 6/1997 | Bartley | 5/611 |
| 5,758,586 A | | 6/1998 | Kieser et al. | |
| 6,158,720 A | | 12/2000 | Patrick et al. | |

FOREIGN PATENT DOCUMENTS

| | | | | |
|---|---|---|---|---|
| GB | 621020 | * | 4/1949 | 187/214 |

* cited by examiner

*Primary Examiner*—Steven A. Bratlie
(74) *Attorney, Agent, or Firm*—Wegman, Hessler & Vanderburg

(57) ABSTRACT

The present invention relates to an ergonomic platform lift of the type that can be vertically adjusted while supporting a person thereon. More specifically, this lift combines rack and pinion units with at least one screw jack so that a person can be solidly supported without any tilting in the lift and so that the height of the lift can be adjusted with great precision.

24 Claims, 5 Drawing Sheets

ERGONOMIC PLATFORM LIFT

FIELD OF THE INVENTION

The present invention relates to an ergonomic platform lift of the type that can be vertically adjusted while supporting a person thereon. More specifically, this lift combines rack and pinion units with at least one screw jack with self-locking thread so that a person can be solidly supported without any tilting in the lift and so that the height of the lift can be adjusted with great precision.

BACKGROUND OF THE INVENTION

In certain occupations, it is often necessary to use an apparatus to raise or lower a person to a desired height while having that person be solidly supported thereon.

Accordingly, platform lifts provide solid support and allow the placement of people, such as workers, at optimal heights to properly perform specified tasks. With a focus towards the workplace, proper height placement of workers on lifts providing solid support allows workers to safely perform tasks using proper body mechanics. As such, platform lifts can reduce worker injuries and increase work productivity.

The present platform lift differentiates from other types of lifting platforms in that this lift combines rack and pinion units with at least one screw jack to afford a person a solid support and give them the ability to adjust the height of the lift with great precision. This invention is most suitably adapted for use in connection with assembly lines used in food processing, material handling, manufacturing plants, such as automotive plants, and the like.

SUMMARY OF THE INVENTION

The present invention is directed to an ergonomic platform lift adapted to move vertically such that the height of a worker situated thereon can be adjusted to an optimum working height. The present invention further provides a worker with a solid support and the ability to adjust the height of the lift with great precision. The invention is best suited for use along an assembly line.

The platform lift includes a floor plate having a bottom surface and opposing longitudinal and lateral side edges. An upper movable frame supports the floor plate and is secured to the bottom surface of the floor plate.

The platform lift further comprises at least one jack screw supported by a lower stationary frame and operably connected with the floor plate to provide vertical movement or displacement of the floor plate thereof. A driving mechanism, preferably a motor, drives at least one screw jack to vertically move the floor plate. If more than one screw jack is used, the screw jacks are operably connected to each other by a drive shaft such that the driving mechanism drives at least one screwjack causing simultaneous movement of each due to the drive shaft connection therebetween. In a preferred embodiment, first and second screw jacks are operably connected therebetween by a drive shaft, are driven by a motor, and operably connected to the floor plate for vertical movement thereof.

The platform lift further includes first and second rack and pinion assemblies positioned apart and located below the floor plate for stabilization of the floor plate and to prevent tilting thereof. Each rack is fixedly mounted to the lower frame with the pinions carried and supported by an extension of the upper movable frame. The first and second rack and pinion assemblies are comprised of first and second rack and pinion units which also are positioned apart. In a preferred embodiment the first and second rack and pinion assemblies are positioned apart proximate opposing lateral side edges of the floor plate, and each of the first and second rack and pinion units of the first and second rack and pinion assemblies are positioned apart proximate opposing longitudinal side edges of the floor plate.

Each of the first and second rack and pinion units comprise a stationary rack securely supported vertically by the lower frame and a pinion supported by the upper frame for vertical movement with the floor plate. The pinion further is operably associated with the stationary rack for rotational movement therealong during vertical movement of the floor plate. Each pinion of the first rack and pinion assembly and each pinion of the second rack and pinion assembly further is operably connected therebetween by a cross shaft to allow simultaneous rotation of each pinion during vertical movement of the floor plate.

Additionally, multiple rollers are supported by the upper frame for vertical movement with the floor plate wherein one of each roller is located adjacent each stationary rack such that the rack is sandwiched between the roller and a pinion to increase the stability of the floor plate. During vertical movement of the floor plate, the roller moves along the rack in unison with the pinion.

To operate the lift, a worker activates the motor which, in turn, activates the screw jack system for vertical movement of the floor plate to a desired position. As the floor plate is raised or lowered by the screw jack(s), the pinions and associated rollers move in unison along their respective racks to provide stability to the floor plate. Notably, the use of a screw jack(s) allows precise adjustment of the floor plate when placing a worker at their optimum working height.

Accordingly, it is an object of the invention to provide a vertically adjustable platform lift that will provide a solid support for a worker so that the lift does not tilt.

It is another object of the invention to provide a vertically adjustable platform lift which can accommodate people having a wide range of heights.

Lastly, it is another object of the invention to provide a vertically adjustable platform lift that allows a worker the ability to adjust the height of the lift with great precision.

The invention will be further described in conjunction with the appended drawings and following detailed description.

DETAILED DESCRIPTION OF THE PREFERRED EMBODIMENT

FIGS. 1–5 show the present invention which concerns an ergonomic platform lift 10 of the type that can be vertically adjusted to control the height of an individual supported thereon while providing a firm and solid support therefore.

Figure 1:
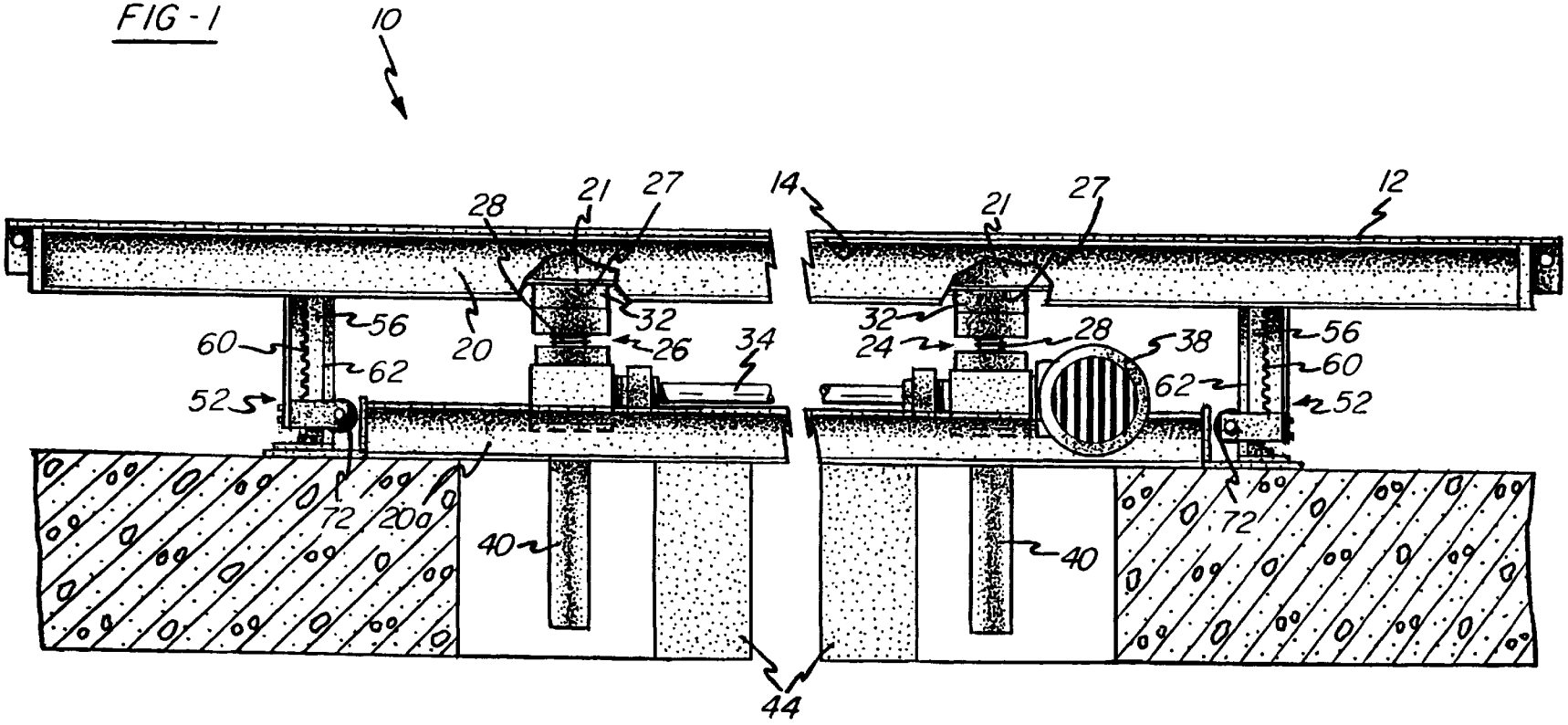
FIG. 1 is a cut-away elevated longitudinal side view of the platform lift of the present invention wherein a portion of the frame has been cut-away to reveal the association between the crossbeam and first and second screw jacks.
Figure 2:
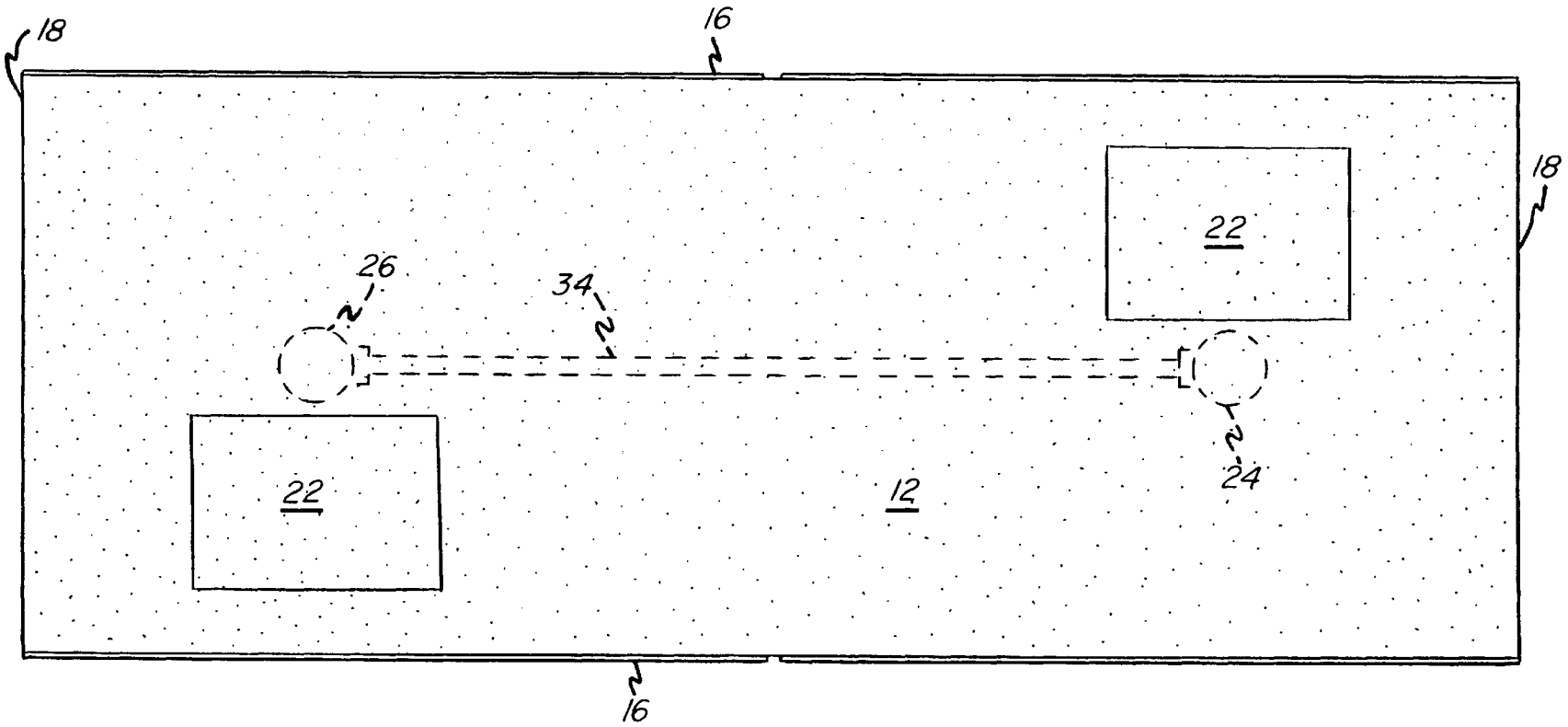
FIG. 2 is a top plan view of the platform lift of the present invention wherein shown in phantom are first and second screw jacks connected by a drive shaft.
Figure 3:
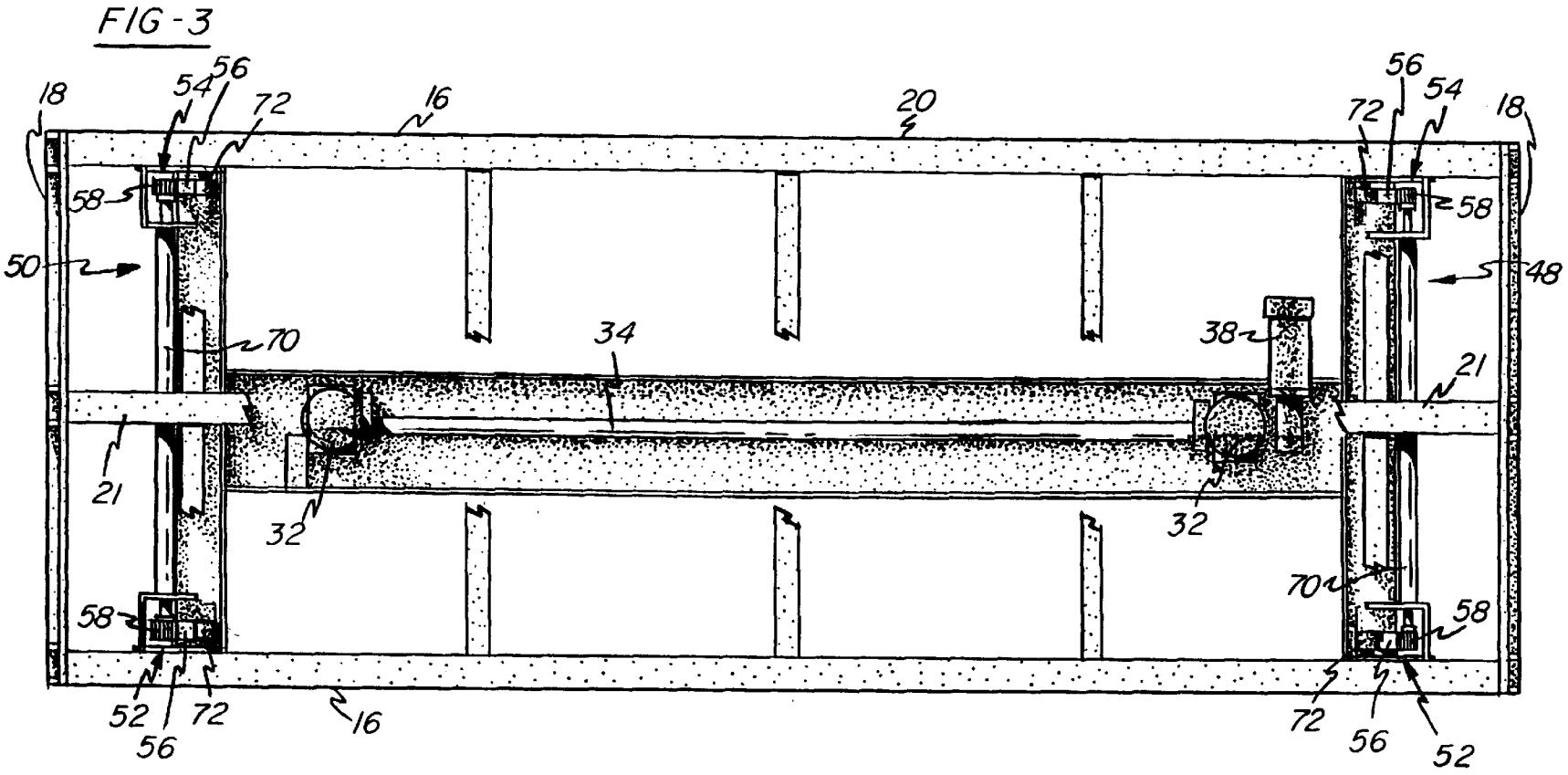
FIG. 3 is a top plan view of the platform lift of the present invention wherein the floor plate has been partially removed and the crossbeam has been partially cut-away.
Figure 4:
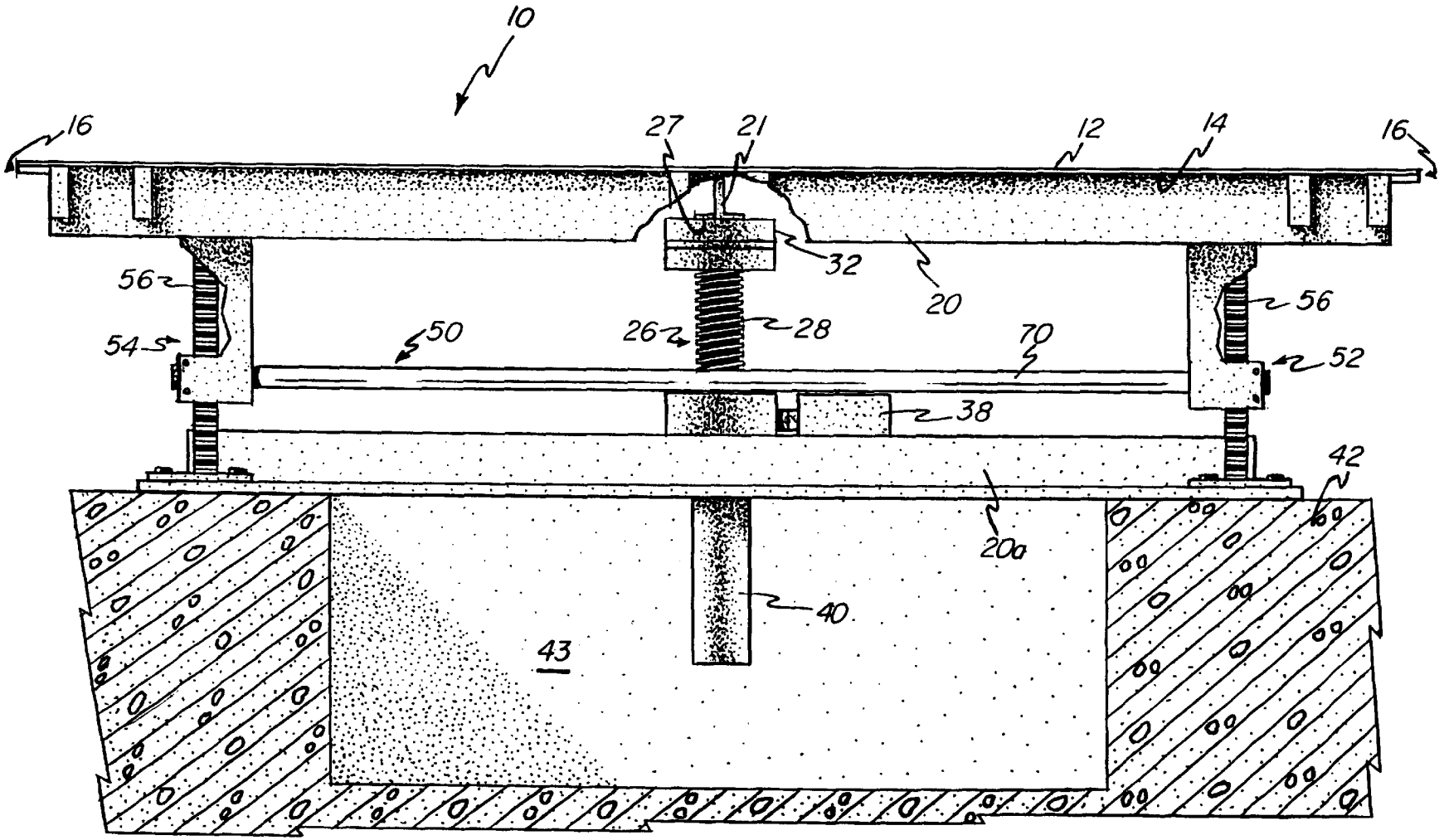
FIG. 4 is an elevated lateral side view of the platform lift of the present invention wherein a portion of the frame has been cut-away to reveal the association between the crossbeam and a screw jack and to reveal stationary racks.

In a preferred embodiment, as shown in FIG. 1, the platform lift 10 includes a floor plate 12 preferably made of a metal, such as steel, having a bottom surface 14 and opposing longitudinal and lateral side edges 16, 18 (FIG. 2). An upper, movable frame 20, also preferably made of a metal, such as steel, supports the floor plate 12 and is secured thereto preferably by welding. As best shown in FIGS. 3 and 4, the upper frame 20 further includes a crossbeam 21 having a bottom surface 27 and extending substantially centrally substantially adjacent the bottom surface 14 and parallel with the longitudinal side edges 16 of the floor plate 12 for additional support thereof.

As shown in FIG. 2, the floor plate 12 additionally may comprise at least one access panel 22 for access therebelow. The access panel(s) 22 may be set-off from the floor plate 12 by being painted a different color than the floor plate 12 and either may be hinged to the floor plate 12 for easy opening or adapted such that the access panel(s) 22 can be completely removed.

FIG. 1 further shows the platform lift 10 comprising a first and second screw jack 24, 26 vertically supported by a lower stationary frame 20*a* and operably connected with the bottom surface 14 of the floor plate 12 to provide vertical displacement of the floor plate 12. More particularly, each screw jack 24, 26 comprises a jack portion 28 that is vertically adjustable and which comprises a top portion having a lifting surface 32 that preferably is secured to the bottom surface 27 of the crossbeam 21 so that the floor plate 12 can be raised or lowered as the jack portion 28 vertically moves. The artisan will appreciate that the lifting surfaces 32 also could be secured directly to the bottom surface 14 of the floor plate 12.

Each screw jack 24, 26 preferably has a 10-ton lifting capacity and about 12 inches of vertical movement. Although the preferred embodiment comprises first and second screw jacks 24, 26, the artisan will appreciate that the floor plate 12 could be vertically moved with just a single screw jack or with a plurality thereof.

The first and second screw jacks 24, 26, shown in FIG. 1, further are operably connected by a common drive shaft 34. A driving mechanism, such as a motor 38, is operably connected to at least one of the screwjacks 24, 26. The jacks may be driven for reciprocal upward and downward motion in the vertical direction by employment of suitable gear connection drives such as the worm and wheel gear arrangements as shown in U.S. Pat. No. 6,158,720—hereby incorporated by reference herein. In FIG. 1, the motor 38 is shown operably connected to the first screw jack 24. Accordingly, the motor 38 drives the first screw jack 24, causing the second screw jack 26 to move simultaneously due to the connection therebetween by the common drive shaft 34. Consequently, the screw jacks 24, 26 are able to simultaneously vertically move the upper frame 20, thereby carrying the floor plate 12.

As shown in FIG. 3, the first and second screw jacks 24, 26 preferably are positioned centrally between the opposing longitudinal side edges 16 and proximate the opposing lateral side edges 18 to help balance the floor plate 12. The access panel(s) 22 (FIG. 2) in the floor plate 12 can be positioned proximate the first and second screw jacks 24, 26 for access thereto. As best shown in FIG. 1, each screw jack 24, 26 further comprises a base 40 adapted to house the jack portion 28, especially when the jack portion 28 is completely retracted. Notably, the base 40 of each screw jack 24, 26 extends below the base frame 20 thereby creating a need for the platform lift 10 to be supported such that each base 40 can be accommodated. Consequently, the longer the jack portion 28, the longer the base 40. Accordingly, the platform lift 10 should be installed onto a platform 42 (FIG. 4) having a covered central pit or opening 43 to accommodate the jack extension, or it may be placed on supports 44 (FIG. 1) that are elevated relative to the support floor to accommodate for the jack extensions.

FIG. 3 shows the platform lift 10 having first and second rack and pinion assemblies 48, 50 positioned apart proximate opposing lateral side edges 18 of the floor plate 12 and, as best represented in FIG. 4, supported by the upper frame 20 for stabilization and to prevent tilting thereof. As further shown in FIG. 3, the first and second rack and pinion assemblies 48, 50 have first and second rack and pinion units 52, 54 which preferably are positioned apart proximate opposing longitudinal side edges 16 of the floor plate 12.

Figure 5:
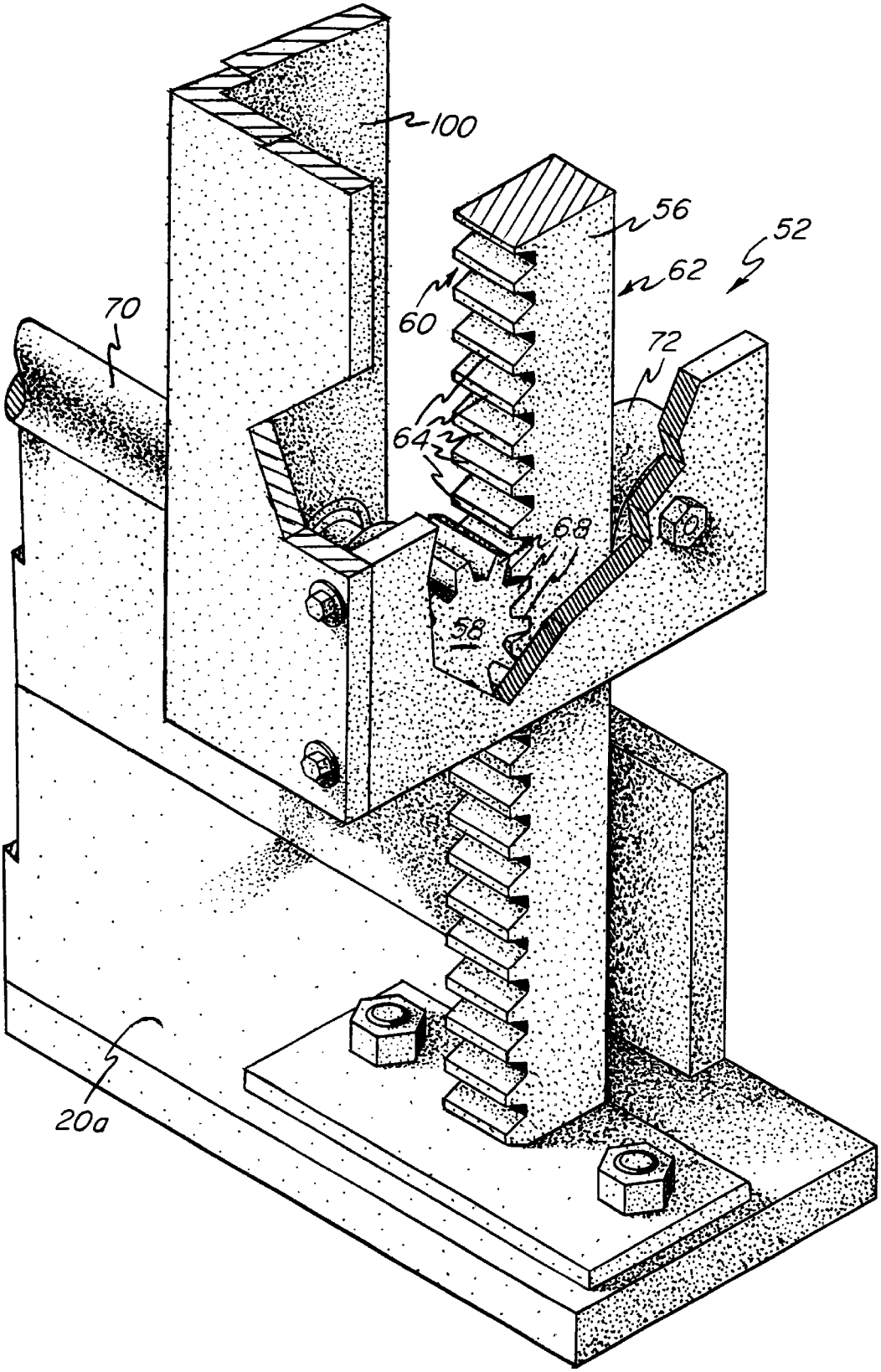
FIG. 5 is a cut-away perspective view of a rack and pinion unit of the present invention.

FIGS. 4 and 5 best show that each of the first and second rack and pinion units 52, 54 are comprised of a stationary rack 56 and a pinion 58. Each rack 56 being securely supported vertically by the lower frame 20*a* and comprises opposing first and second mating surfaces 60, 62 with the first mating surface 60 having a row of teeth 64 vertically aligned. Each pinion 58 is supported by the vertical extension 100 of upper frame 20 for vertical movement with the floor plate 12 and contains a row of teeth 68 aligned therearound to mate with the row of teeth 64 on the first mating surface 60 of a stationary rack 56. Each pinion 58 further is operably associated with a stationary rack 56 for rotational movement along the first mating surface 60 during vertical movement of the upper frame 20 carrying the floor plate 12. Each pinion 58 of the first rack and pinion assembly 48 and each pinion 58 of the second rack and pinion assembly 50 is operably connected therebetween by a cross shaft 70 to allow simultaneous rotation of each pinion 58 during vertical movement of the upper frame 20.

FIGS. 1, 3 and 5 further show multiple rollers 72 supported by the vertical extension 100 of upper frame 20 for vertical movement with the floor plate 12 wherein one of each rollers 72 is positioned adjacent the second mating surface 62 of a rack 56 so that each rack 56 is sandwiched between a roller 72 and a pinion 58. Each roller 72 further is operably associated with the stationary rack 56 and operably connected with a pinion 58 for simultaneous movement along the rack 56 during vertical movement of the floor plate 12. The rollers 72 are adapted to rotate or slide along the second mating surface 62.

To operate the lift 10, a worker activates the motor 38 which, in turn, drives the first and second screw jacks 24, 26 simultaneously due to the connection by the drive shaft 34. The jack portions 28 of the screw jacks 24, 26 move up or down to raise or lower the upper frame thereby carrying floor plate 12 to a desired position. As the floor plate 12 is raised or lowered by the screw jacks 24, 26, the pinions 58 and rollers 72 move up or down in unison along their respective rack 56 to keep the floor plate 12 stable. As noted earlier, the use of screw jacks 24, 26 allows precise adjustment of the floor plate 12 when placing a worker at his/her optimum working height. When a new height is desired, the platform lift 10 easily may be readjusted.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. A platform lift comprising:

a floor plate having a bottom surface;

an upper frame supporting said floor plate;

at least one screw jack operably connected with said bottom surface of said floor plate for vertical movement thereof;

a driving mechanism operably connected to said at least one screw jack for driving said at least one screw jack to vertically move said floor plate;

first and second rack and pinion assemblies positioned apart and located below said floor plate to stabilize and inhibit tilting of said floor plate, said first and second rack and pinion assemblies comprising first and second rack and pinion units, each of said first and second rack and pinion units comprising a stationary rack and a pinion, said pinions being carried by said upper frame, each of said pinions further being operably associated with one of said stationary racks for engagement with said rack during movement of said floor plate, and said pinions being operably connected therebetween for common movement of said pinions along saidracks; and multiple rollers carried by said upper frame for simultaneous movement with said floor plate, each of said multiple rollers being located adjacent one of said stationary racks so that each said rack is substantially sandwiched between one of said rollers and one of said pinions each.

2. The platform lift as recited in claim 1 wherein said floor plate further has opposing longitudinal and lateral side edges, said first and second rack and pinion assemblies being positioned apart proximate said opposing lateral side edges, and each of said first and second rack and pinion units of said first and second rack and pinion assemblies being positioned apart proximate said opposing longitudinal side edges.

3. The platform lift as recited in claim 1 wherein said upper frame further includes a crossbeam having a bottom surface, said crossbeam extending substantially centrally adjacent said bottom surface of said floor plate for additional support thereof, and wherein said at least one screw jack further comprises a jack portion being vertically adjustable and including a top portion having a lifting surface secured to said bottom surface of said crossbeam so that said floor plate can be vertically adjusted as said jack portion vertically moves.

4. The platform lift as recited in claim 1 wherein said floor plate further comprises at least one access panel for access below said floor plate.

5. The platform lift as recited in claim 1 wherein said upper frame is secured to said bottom surface of said floor plate.

6. The platform lift as recited in claim 1 wherein said at least one screw jack comprises about 12 inches of vertical movement.

7. The platform lift as recited in claim 1 wherein said at least one screw jack comprises a first and second screw jack operably connected for simultaneous movement thereof and operably connected with said bottom surface of said floor plate, and said driving mechanism being operably connected to at least one of said first and second screw jacks for driving said first and second screw jacks to simultaneously vertically move said floor plate.

8. The platform lift as recited in claim 7 wherein said first and second screwjacks are operably connected by a drive shaft.

9. The platform lift as recited in claim 1 wherein said driving mechanism comprises a motor operably connected to said at least one screw jack.

10. The platform lift as recited in claim 1 wherein each said pinion of said first rack and pinion assembly and each said pinion of said second rack and pinion assembly is operably connected therebetween by a cross shaft.

11. The platform lift as recited in claim 1 wherein said stationary rack comprises opposing first and second mating surfaces, said first mating surface having a row of teeth vertically aligned on said rack, said pinion having a row of teeth aligned therearound to mate with said teeth of said stationary rack, and one of said multiple rollers being located adjacent said second mating surface wherein said pinion and said one of said multiple rollers are operably associated with said stationary rack for simultaneous movement along said first and second mating surfaces as said floor plate vertically moves.

12. A platform lift comprising:

an upper frame;

a floor plate supported by said upper frame and having a bottom surface;

first and second screw jacks operably connected with said floor plate for vertical movement thereof, said first and second screw jacks further operably connected for simultaneous vertical movement;

a driving mechanism operably connected to at least one of said first and second screw jacks for driving said first and second screw jacks in unison to simultaneously vertically move said floor plate;

first and second rack and pinion assemblies positioned apart and located below said floor plate for stabilization and to prevent tilting thereof, said first and second rack and pinion assemblies comprising first and second rack and pinion units positioned apart, each of said first and second rack and pinion units comprising a stationary rack and a pinion supported by said upper frame for vertical movement with said floor plate, said pinion further being operably associated with said stationary rack for rotational movement therealong during vertical movement of said upper frame, and each said pinion of said first rack and pinion assembly and each said pinion of said second rack and pinion assembly being operably connected therebetween for simultaneous rotation of each said pinion during vertical movement of said upper frame; and multiple rollers supported by said upper frame for vertical movement with said floor plate, one of said multiple rollers being located adjacent said stationary rack so that each said rack is substantially sandwiched between said one roller and said pinion, said one roller further being operably associated with said stationary rack and operably connected with said pinion for simultaneous movement along said stationary rack as said upper frame vertically moves.

13. The platform lift as recited in claim 12 wherein said floor plate further has opposing longitudinal and lateral side edges, said first and second rack and pinion assemblies being positioned apart proximate said opposing lateral side edges, and each of said first and second rack and pinion units of said first and second rack and pinion assemblies being positioned apart proximate said opposing longitudinal side edges.

14. The platform lift as recited in claim 12 wherein said upper frame further includes a crossbeam having a bottom surface, said crossbeam extending substantially centrally adjacent said bottom surface of said floor plate for additional support thereof, and wherein said first and second screw jacks further comprise a jack portion being vertically adjustable and including a top portion having a lifting surface secured to said bottom surface of said crossbeam so that said floor plate can be vertically adjusted as said jack portion vertically moves.

15. The platform lift as recited in claim 12 wherein said floor plate further comprises at least one access panel for access below said floor plate.

16. The platform lift as recited in claim 12 wherein said upper frame is secured to said bottom surface of said floor plate.

17. The platform lift as recited in claim 12 wherein said first and second screw jacks comprises about 12 inches of vertical movement.

18. The platform lift as recited in claim 12 wherein said first and second screw jacks are operably connected by a drive shaft.

19. The platform lift as recited in claim 12 wherein said driving mechanism comprises a motor.

20. The platform lift as recited in claim 12 wherein each said pinion of said first rack and pinion assembly and each said pinion of said second rack and pinion assembly is operably connected therebetween by a cross shaft.

21. The platform lift as recited in claim 12 wherein said stationary rack comprises opposing first and second mating surfaces, said first mating surface having a row of teeth vertically aligned on said rack, said pinion having a row of teeth aligned therearound to mate with said teeth of said stationary rack, and said one roller being located adjacent said second mating surface wherein said pinion and said one roller are operably associated with said stationary rack for simultaneous movement along said first and second mating surfaces as said floor plate vertically moves.

22. A platform lift comprising:

an upper frame;

a floor plate carried by said upper frame and having a bottom surface and opposing longitudinal and lateral side edges;

first and second screw jacks operably connected with said floor plate for vertical movement thereof, said first and second screw jacks further operably interconnected for simultaneous vertical movement;

a motor operably connected to at least one of said first and second screw jacks for driving said first and second screw jacks in unison to simultaneously vertically move said floor plate;

first and second rack and pinion assemblies positioned apart proximate said opposing lateral side edges and located below said floor plate for stabilization and to prevent tilting thereof, said first and second rack and pinion assemblies comprising first and second rack and pinion units positioned apart proximate said opposing longitudinal side edges, each of said first and second rack and pinion units comprising a stationary rack and a pinion supported by said upper frame for vertical movement with said floor plate, said stationary rack comprising opposing first and second mating surfaces, said first mating surface having a row of teeth vertically aligned on said rack, said pinion having a row of teeth aligned therearound to mate with said teeth of said stationary rack said pinion further being operably associated with said stationary rack for rotational movement along said first mating surface as said floor plate vertically moves, and each said pinion of said first rack and pinion assembly and each said pinion of said second rack and pinion assembly being operably connected therebetween by a cross shaft for simultaneous rotation of each said pinion during vertical movement of said floor plate; and multiple rollers supported by upper frame for vertical movement with said floor plate, one of said multiple rollers being located adjacent said second mating surface of said stationary rack so that each said rack is substantially sandwiched between said one roller and said pinion, said one roller further being operably associated with said stationary rack and operably connected with said pinion for simultaneous movement along said stationary rack as said floor plate vertically moves.

23. The platform lift as recited in claim 22 wherein said upper frame further includes a crossbeam having a bottom surface, said crossbeam extending substantially centrally adjacent said bottom surface of said floor plate and parallel said longitudinal side edges of said floor plate for additional support thereof, and wherein said first and second screw jacks further comprise a jack portion being vertically adjustable and including a top portion having a lifting surface secured to said bottom surface of said crossbeam so that said floor plate can be vertically adjusted as said jack portion vertically moves.

24. The platform lift as recited in claim 22 wherein said first and second screw jacks are positioned centrally between said opposing longitudinal side edges and proximate said opposing lateral side edges.

* * * * *